US006834450B2

(12) United States Patent
Gross et al.

(10) Patent No.: US 6,834,450 B2
(45) Date of Patent: Dec. 28, 2004

(54) IRONING BOARD TOP AND IRONING BOARD INCLUDING THE SAME

(75) Inventors: Christian Gross, Netphen (DE); Norbert Pakusa, Schweighausen (DE)

(73) Assignee: Leifheit AG, Nassau (DE)

( * ) Notice: Subject to any disclaimer, the term of this patent is extended or adjusted under 35 U.S.C. 154(b) by 0 days.

(21) Appl. No.: 10/325,156

(22) Filed: Dec. 20, 2002

(65) Prior Publication Data

US 2003/0121186 A1 Jul. 3, 2003

(30) Foreign Application Priority Data

Dec. 20, 2001 (DE) ..... 101 62 734

(51) Int. Cl.[7] ..... D06F 81/04; A47B 3/08

(52) U.S. Cl. ..... 38/137; 108/119

(58) Field of Search ..... 108/115, 118, 108/119; 38/137, 103, 135, 136, 138, 139, DIG. 1, DIG. 2; 264/DIG. 16; D32/66

(56) References Cited

U.S. PATENT DOCUMENTS

| | | | | | |
|---|---|---|---|---|---|
| 2,912,775 | A | | 11/1959 | Gettelman | |
| 3,268,636 | A | * | 8/1966 | Angell, Jr. | 264/51 |
| 3,702,100 | A | * | 11/1972 | Wharton | 108/53.3 |
| 4,579,872 | A | * | 4/1986 | Johnson | 521/60 |
| 4,740,032 | A | * | 4/1988 | Olsen et al. | 297/139 |
| 5,161,316 | A | * | 11/1992 | Saito | 38/36 |
| RE34,450 | E | * | 11/1993 | Saito | 38/137 |
| 5,433,034 | A | * | 7/1995 | Bernstein | 38/103 |
| 5,572,811 | A | * | 11/1996 | Lehrman | 38/106 |
| 5,706,593 | A | * | 1/1998 | Allard et al. | 38/103 |
| 6,010,185 | A | * | 1/2000 | Petersen | 297/158.3 |
| 6,349,490 | B1 | * | 2/2002 | Gross et al. | 38/140 |

FOREIGN PATENT DOCUMENTS

| | | | |
|---|---|---|---|
| CH | 672152 | * | 10/1989 |
| DE | 80 06 001 U1 | | 5/1980 |
| EP | 1 002 895 A1 | | 5/2000 |
| GB | 1017572 | | 4/1963 |

* cited by examiner

*Primary Examiner*—Ismael Izaguirre
(74) *Attorney, Agent, or Firm*—Frishauf, Holtz, Goodman & Chick, P.C.

(57) ABSTRACT

An ironing board top made of a one-piece body of molded hard foam plastics material such as polypropylene. The hard foam plastics material may have a closed-cell structure. Guide and bearing rails may be integrally formed on the molded body to movably connect an ironing stand to the molded body. In the alternative, the guide and bearing rails may be separate from the molded body and then connected thereto. The molded body may include indentations and/or protuberances formed on a lower surface for receiving components of the ironing stand such as the legs of the ironing stand. One or more layers such as a thermal-radiation-reflecting coating can be provided on the upper surface of the ironing board top. An ironing board includes the ironing board top and a stand.

10 Claims, 4 Drawing Sheets

1
2
4
10
11
12
13
14
15
16
17
18
18(19)
19
20
21
22
23
24
25
26
27
28
29
30
31
32
10(11)

IX
X
2
4
5
6
7
8
9
10
11
23
24
28
30
31
10(11)

IRONING BOARD TOP AND IRONING BOARD INCLUDING THE SAME

FIELD OF THE INVENTION

The present invention relates generally to a top for an ironing board and an ironing board including the same, and more particularly, to an ironing board top made entirely from molded plastic and an ironing board including the same.

BACKGROUND OF THE INVENTION

It has been generally assumed that to obtain a high quality ironing of garments and the like, the moisture occurring during the ironing or released in the form of water vapor while ironing, i.e., produced by a steam iron and/or from the residual moisture in the moist garments being ironed, should escape as much as possible. Accordingly, ironing boards have been developed which include an ironing board top made from a perforated metal plate which is covered by an ironing board cover and has a pad underneath. One such ironing board is shown for example in British Patent No. GB-A 1 017 572.

European Patent Publication No. EP-1 002 895 describes an ironing board which does not require a cover yet is still useable because the presumed problem of moisture retention in the garment during ironing was found to be non-existent.

In order to provide a smooth ironing, it has been found that the heat of the iron and the pressure exerted on the garments by the iron do not significantly affect the smoothness of the garment once ironed. Rather, it is the intentional introduction of moisture in the form of water vapor that results in a smooth ironing. It is also known from commercial (professional) laundries and dry cleaners that substantially only the so-called dry water vapor must be added to the garments to provide a smooth finish. Shirts and blouses, for example, are ironed smooth entirely without pressure, simultaneously being "blown up" or inflated like a balloon.

Household ironing techniques have changed considerably in recent times. Currently, most irons sold are steam irons which generate steam during ironing.

Recently, a new ironing technique has been developed which uses an ironing board top having a structure designed to intentionally prevent, or at least hinder to a considerable extent, the passage of steam through the ironing board top, i.e., in a downward direction when an iron is pressed downward against the ironing board top. As a result of the construction of an ironing board top which partially or completely prevents the passage of steam therethrough, a significant improvement in ironing performance and quality is obtained, in comparison with traditional ironing board tops which allow substantially unrestricted steam flow therethrough. Moreover, by constructing the ironing board top in this manner, it becomes easier to guide and move the iron because a cushion of steam and warm air develops under the iron and the iron slides on this cushion of steam and warm air (this is referred to as the air-cushion, hydrofoil or riding-on-air technique).

Thus, significant advantages are provided by ironing board tops that are substantially impermeable to steam, including enhanced ironing performance and quality. Such an ironing board top could also be constructed to include an additional heat-reflecting material and thus obtain even more operational advantages.

European Patent Publication No. EP-1 002 895 describes two embodiments of an ironing board having an ironing board top which is impermeable to steam and thus enables the above-described advantageous ironing technique. In one embodiment, the ironing board top includes a sandwich or composite plate made of plastic and comprising a top plate, a bottom plate and a honeycomb system arranged between the top and bottom plates. A vapor retardant, or other type of vapor barrier or vapor-impervious member or material, and a pad are also provided in the sandwich plate. The honeycomb system could be replaced by a foam slab.

Although the ironing board top described in European Patent Publication No. EP-1 002 895 allows the advantages of the above-described ironing technique to be obtained, the structure of the ironing board top is relatively complicated so that as a result, it is expensive to manufacture.

In order to set an ironing board aside or store it in a compact manner, it is generally known to make the stand of the ironing board collapsible. Examples of collapsible ironing stands are described in German Utility Model No. DE-U 80 06 001 and U.S. Pat. No. 2,912,775. In the ironing board described in U.S. Pat. No. 2,912,775, a combined guide and bearing plate for pivotable storage of the two legs of the stand and for guiding the displacement of one of the two legs is provided on the underside of the ironing board top.

OBJECTS AND SUMMARY OF THE INVENTION

It is an object of the present invention to provide a new ironing board top and an ironing board including the same.

It is another object of the present invention to provide a new ironing board top that has a relatively simple structure and relatively low manufacturing costs.

It is yet another object of the present invention to provide a new ironing board top in which the passage of steam and water vapor through the ironing board top is substantially or completely prevented.

In order to achieve these objects and others, an ironing board top in accordance with the invention comprises a one-piece molded body made of a hard foam plastics material and having a substantially flat upper surface adapted to enable ironing of garments thereon. The molded body may be mold ed to have the shape of a conventional ironing board, i.e., substantially rectangular with rounded edges on one end and tapering edges on an opposite end. Other shapes are also possible.

An ironing board top in accordance with the invention can be produced economically in a simple manner with the least possible expenditure of time using a molding tool. That is, the ironing board top is essentially molded by the molding tool to have the desired form, i.e., a molded body having a substantially flat upper surface which enables garments to be ironed thereon. By virtue of the molding of the hard foam plastics material, the ironing board top will thus inherently have properties that are important and essential for effectively enabling optimum use of the ironing technique described above, namely, a structure impermeable to steam and which provides thermal insulation. The material used to produce the ironing board top may be a variety of materials (described below) and the ironing board top may have various dimensions. A strength or load-bearing capacity of the molded body and thus of the ironing board top can be attained that is at least as strong as conventional ironing board tops.

To attain the best possible thermal insulation and strength and at the same time a structure that is substantially or completely impermeable to steam, it is possible to make the molded body from a hard foam having a closed-cell structure. Various plastics materials can be used as the raw material for the foam. For example, one possible (perferred) material is polypropylene. Polypropylene is available in high, low and medium density forms. Medium density polypropylene foam is currently preferred. Other plastics having similar or corresponding properties can also be used. The plastics materials can either be processed such that it is formed homogeneously only in a molding tool, i.e., expanded, to make a molded body constituting the ironing board top in accordance with the invention, or in the alternative, a plastics granulate or foam granulate can be used whose foam particles adhere to one another in the molding tool after a treatment method known per se. In the latter case, the plastic or foam granulate is compressed, compacted or densified in the mold of the molding tool. Tempering and/or sintering following the shaping of the molded body in the molding tool leads to further solidification and strengthening (or hardening) of the molded body. Instead of tempering or sintering, other methods for strengthening, solidifying and/or hardening the molded body to make it stronger, more solid and/or harder could be used in accordance with the invention.

As a result of the unitary, continuous foam structure of the molded body constituting the ironing board top in accordance with the invention, the insulation capacity of the molded body to prevent heat conduction or dissipation is substantial such that only a slight, negligible amount of heat produced by the iron, if any, is wasted, e.g., lost by heat conduction downward. However, to further improve the ironing results and to conserve energy, it is advantageous that the top of the molded body is coated with a material that reflects thermal radiation. It is also possible to cover the top of the molded body with a suitable foil or film that acts as an additional vapor barrier or retardant that supplements the vapor-blocking, or vapor-retarding, provided by the material of the molded body. The foil or film coating may be made of metal, such as aluminum foil.

The coating, foil or film is advantageously arranged over the hard foam molded body under the ironing board cover to provide the maximum benefits of the ironing board top in accordance with the invention. The thermal-radiation-reflecting material or coating of the molded body can be located directly under the ironing board cover, which is made for example of cotton fabric, or under an intermediate pad located under the ironing board cover against the molded body. However, since the molded body already has adequate insulating, compensating and cushioning properties, a separate intermediate pad can be dispensed with. Optionally, a coating that reflects radiant heat and/or a separate vapor barrier can also be dispensed with.

In another embodiment of the ironing board top in accordance with the invention, a guide and/or bearing mechanism for the stand of the ironing board may be formed integral with the molded body of the ironing board top. This provides advantages with respect to production and cost as well as advantages with respect to the strength and load-bearing capacity of the ironing board top. In an alternate embodiment, for the cohesion of the molded body with the guide and/or bearing mechanism of the stand, a connecting mechanism may be provided on the molded body and the guide and/or bearing mechanism for connecting the molded body to the stand.

From an aesthetic standpoint as well as for easy handling and storage of the ironing board with the collapsed stand, it is advantageous if the guide and/or bearing mechanism for the stand are located at least partially below the outer contour of the underside of the molded body. In addition to or independent of locating the guide and/or bearing mechanism below the outer contour of the underside of the molded body, it is advantageous if the molded body has indentations and/or protuberances or the like (such as protrusions and raised areas) on its underside arranged to receive elements of the stand of the ironing board, for example, for receiving a part of the legs of the stand. These indentations and/or protuberances can also serve as locking elements of the stand when the stand is in the collapsed state, i.e., to lock the stand to the ironing board top.

To fasten the stand to the molded body, fastening openings for screws or other similar fastening means may be provided in the molded body. The fastening openings are preferably reinforced, e.g., by forming sleeve-like inserts in the molded body. The inserts may be integrally formed with the molded body, e.g., by integral foaming or insert molding.

Other advantageous features of an ironing board top in accordance with the invention and an ironing board including the same can be gleaned from the following description of the invention.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE PREFERRED EMBODIMENTS

Referring first to FIGS. 1-7, an ironing board in accordance with the invention is designated generally as 1 and comprises an ironing board top 2 and a collapsible stand 3. The ironing board top 2 is a one-piece molded body 4 made of a hard foam. The ironing board top 2 is shown in FIGS. 1-7 without any fabric ironing board cover or other layers that may be present such as an intermediate pad and/or a thermal-radiation-reflecting foil, film or the like. The ironing board top 2 preferably has a substantially flat upper surface to enable ironing of garments thereon.

The hard foam from which the molded body 4 is made may be any hard foam preferably a hard foam made of molded plastics material, which satisfies the conditions for use in accordance with the invention. For example, polypropylene may preferably be used. To produce the molded body 4 from such a material, there are several possibilities including the methods discussed above. To provide the molded body 4 with adequate strength and load-bearing capacity, the weight by volume of the hard foam (i.e., polypropylene foam), when the molded body 4 has a thickness on the order of magnitude of about 50 mm, is preferably on the order of magnitude of about 60 g/l and the molded body 4 may be provided with a closed-cell structure. Polypropylene is available in high, low and medium density forms. Medium density polypropylene foam is currently preferred.

Other plastics having similar or corresponding properties can also be used. The plastics materials can either be processed such that it is formed homogeneously only in a molding tool, i.e., expanded, to make a molded body constituting the ironing board top in accordance with the invention, or in the alternative, a plastics granulate or foam granulate can be used whose foam particles adhere to one another in the molding tool after a treatment method known per se. In the latter case, the plastic or foam granulate is compressed, compacted or densified in the mold of the molding tool. Tempering and/or sintering following the shaping of the molded body in the molding tool leads to further solidification and strengthening (or hardening) of the molded body. Instead of tempering or sintering, other methods for strengthening, solidifying and/or hardening the molded body to make it stronger, more solid and/or harder could be used in accordance with the invention.

Figures 8, 9, 10, 11, 12:
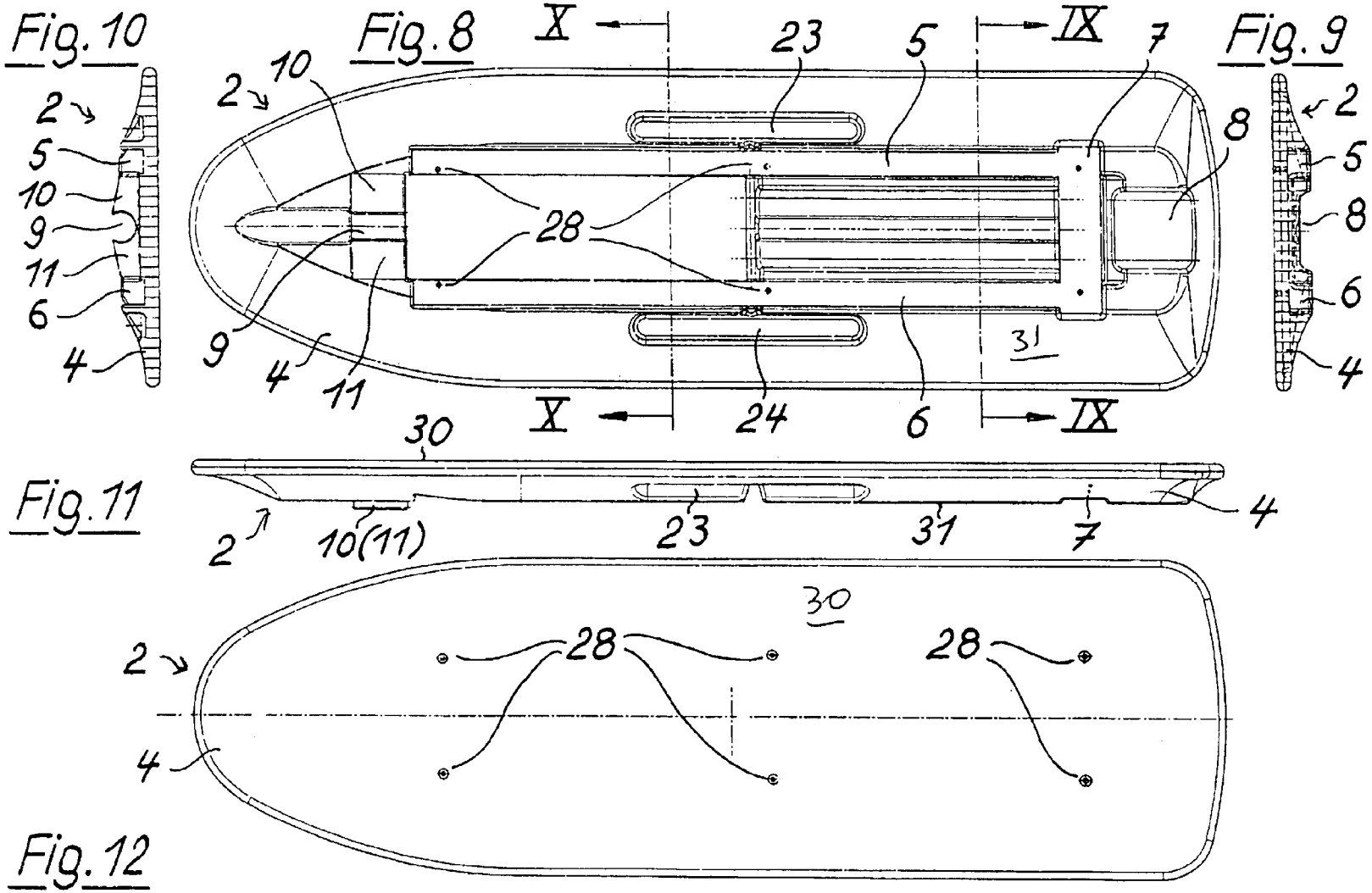
FIG. 8 is a bottom view of the molded body of the ironing board top in accordance with the invention.
FIG. 9 is a sectional view of the molded body shown in FIG. 8 taken along the line IX—IX in FIG. 8.
FIG. 10 is a sectional view of the molded body shown in FIG. 8 taken along the line X—X in FIG. 8.
FIG. 11 is a side view of the molded body shown in FIG. 8.
FIG. 12 is a top view of the molded body shown in FIG. 8.

On the underside of the molded body 4, indentations and/or protuberances 5, 6, 7, 8, 9 (as well as indentations and/or protuberances 10 and 11 as shown in FIGS. 8-10) are formed and adapted to receive elements of the stand 3 of the ironing board 1. Instead of indentations or protuberances 5–11, protrusions and raised areas may be provided, to the extent different than indentations and protuberances. The elements received by indentations 5–9 are guide and bearing rails 12, 13 which guide two pivotable legs 14 and 15 of the stand 3. The elements received by the indentations and/or protuberances 5–9 thus also include the legs 14, 15.

A significant portion of the legs 14,15 are located at least partially if not completely below surface regions 18,19 that determine the outer contour of the underside or lower surface 31 of the molded body 4. However, relatively short regions of the free ends of the legs 14,15 connected to a respective foot 16,17 are located beyond the periphery of the molded body 4 and not below the surface regions 18, 19.

Pivot pins 20, 21, 22, of the legs 14, 15 are also located below the outer contour of the underside 31 of the molded body 4. Pivot pin 22 has guide rollers on its ends that guide the guide and bearing rails 12, 13.

The molded body 4 has integrated or integral handles or grip regions 23, 24 which enable convenient handling of the ironing board 1. Handles 23,24 are located in an approximately central location along the longitudinal sides 25, 26 of the molded body 4.

Figure 1:
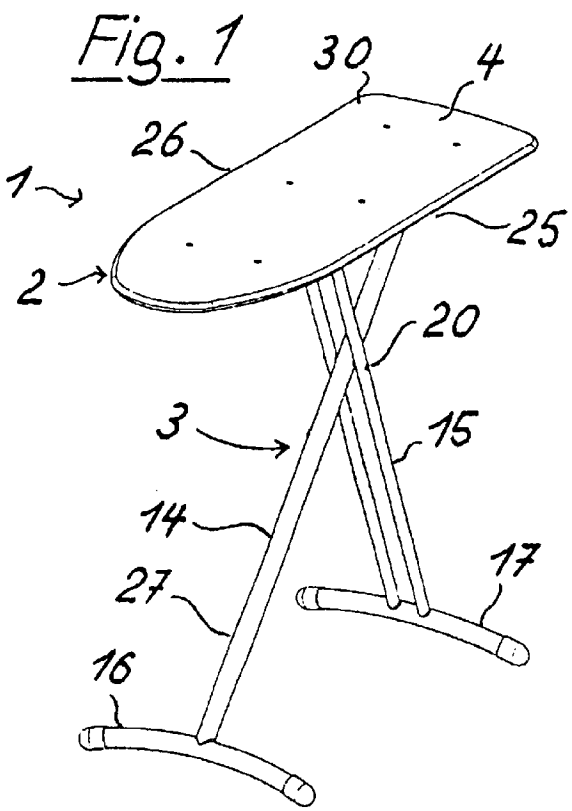
FIG. 1 is a perspective view of an ironing board with an ironing board top in accordance with the invention with the stand in an open state.
Figure 2:
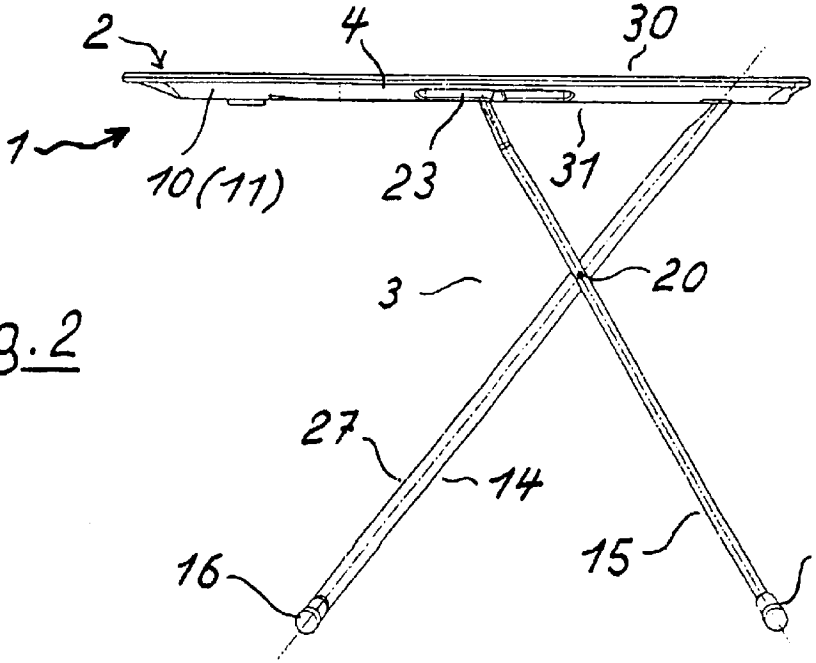
FIG. 2 is a side view of the ironing board of FIG. 1 with the stand in the open state.
Figure 3:
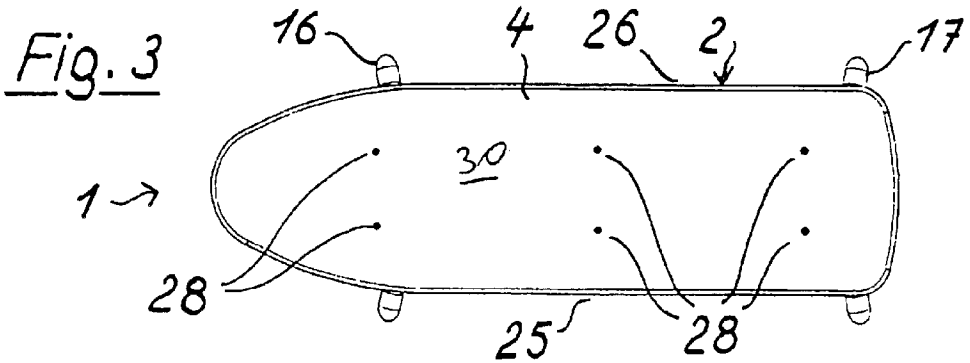
FIG. 3 is a top view of the ironing board of FIG. 1 with the stand in the open state.

A detent mechanism for the region of the leg 14 located close to the foot 16 is also integrally formed on the molded body 4. The detent mechanism is formed by the two protuberances 10, 11. The protuberances 10,11 are shaped and dimensioned such that in the collapsed state of the stand 3 of ironing board 1, they grip a region 27 of the leg 14 firmly and slightly resiliently over the diameter of the leg 14 and surround it to a certain extent so that a detent action is thereby attained. The portion of the leg 14 which is gripped may be tubular. A similar detent or locking mechanism can be provided for the applicable ends of the leg 15 which may be formed from two tubes as shown in FIG. 1.

For fastening the stand 3 to the molded body 4, reinforced fastening openings 28 are provided in the molded body 4. Opposite the fastening openings 28, additional fastening openings or threaded bores are provided in the two guide and bearing rails 12, 13 of the stand 3. The guide and bearing rails 12, 13 may be joined together by a connecting part 29 to form an overall U-shaped structure, which is preferably made of metal to thereby constitute a metal frame part. The fastening openings 28 are accessible from the upper surface 30 of the molded body 4 (see FIG. 3). However, it is also possible to provide corresponding fastening openings, such as cup-shaped threaded sleeves, in the molded body 4 that are accessible only from an underside 31 of the molded body 4, and that are preferably integrated with the molded body 4, e.g., by integral foaming (i.e. insert molding).

Figures 4, 5, 6, 7:
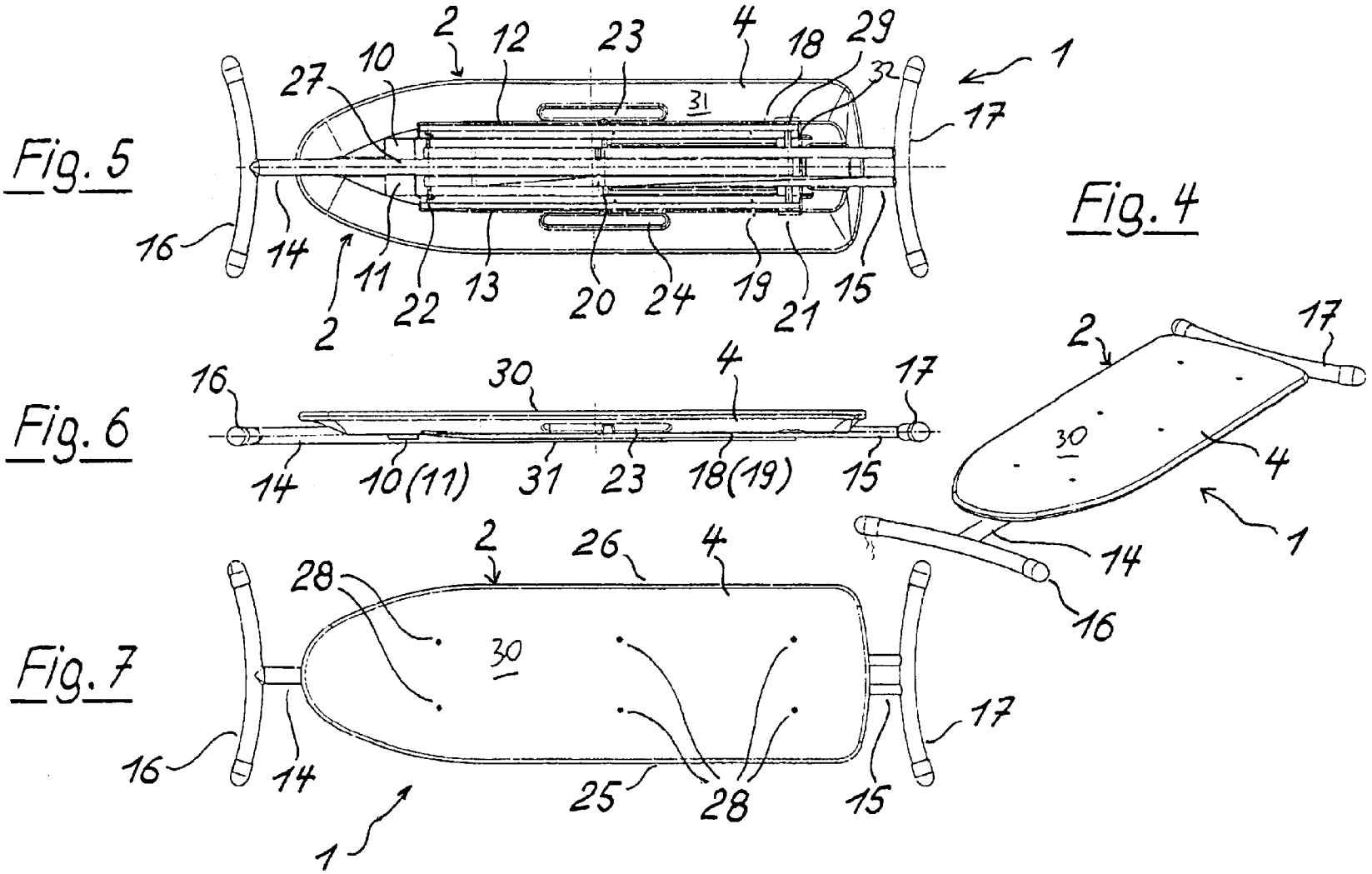
FIG. 4 is a perspective view of the ironing board of FIG. 1 with the stand in a collapsed state.
FIG. 5 is a bottom view of the ironing board of FIG. 1 with the stand in the collapsed state.
FIG. 6 is a side view of the ironing board of FIG. 1 with the stand in the collapsed state.
FIG. 7 is a top view of the ironing board of FIG. 1 with the stand in the collapsed state.

The stand 3 includes one or more springs 32 to improve the handling and use of the ironing board 1 (see FIG. 5). The springs 32 engage the guide and bearing rails 12, 13 and one and both legs 14 and 15 of the stand 3. In one embodiment, the spring(s) 32 may be torsion springs.

Figure 13:
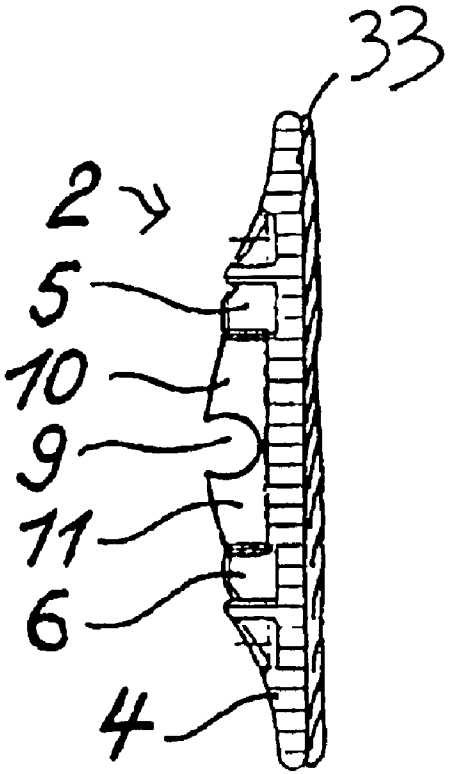
FIG. 13 is another sectional view of the molded body shown in FIG. 8 taken along the line IX—IX in FIG. 8 additionally showing a thermal-radiation-reflecting coating.

As shown in FIG. 13, the upper surface 30 of the molded body 4 may be covered or coated with a layer of thermal-radiation reflecting material 33. The layer of thermal-radiation-reflecting material 33 improves the ironing results and conserves energy during ironing. The layer 33 in FIG. 13 is preferably a metallic foil or layer, and preferably aluminum foil. The layer 33 is shown in FIG. 13 in an exaggerated thickness for ease of illustration and description.

Figure 14:
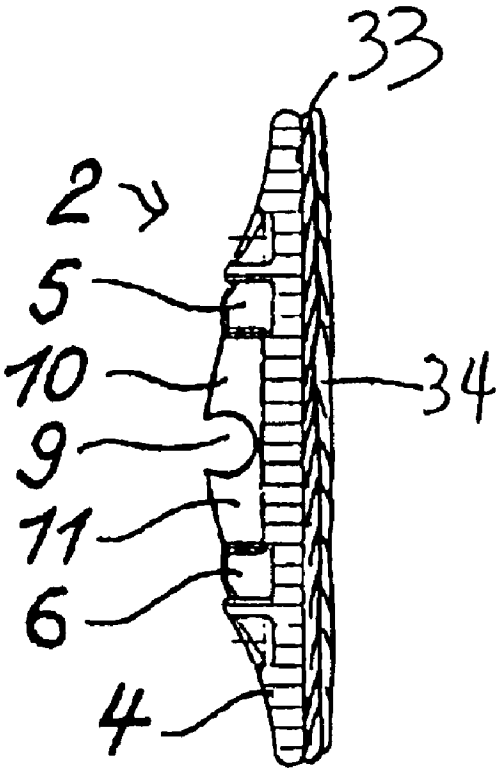
FIG. 14 is a view similar to FIG. 13 but showing a two layer coating on the ironing board tip.

FIG. 14 shows another embodiment wherein the upper surface 30 of the molded body 4 is covered or coated with two layers of material. Examples for such a multiple layer coating is the layer 33 being a soft foam or felt material, and the outer layer 34 being a cotton or aluminum/metallic foil layer. Alternatively, the outer layer 34 can be layer of textile material.

If desired, the layer 33 could be made from cotton or aluminum/metallic foil, and the outer layer 34 could be made from a soft foam or felt material. The materials for layers 33 and 34, described above, are given by way of example. Other equivalent or material having similar characteristics could be used.

The ironing board top can be produced in several ways. In one embodiment, the one-piece, homogeneous molded body 4 is formed in a mold of a molding tool from plastic such as polypropylene. The manner in which a molded body can be formed or foamed from plastic to have a homogeneous composition is readily ascertainable to one of ordinary skill in the art in view of the disclosure herein, without undue experimentation. In the alternative, the ironing board top can be produced by compressing plastic or foam granulate in a mold of a molding tool to form a one-piece molded body 4 and then tempering/sintering the molded body to harden the molded body. The molded body 4 may be formed with the integral indentations and/or protuberances 5–9, detent mechanism 10, 11, handles 23,24, fastening openings 28 (reinforced or not) and optional guide and bearing rails 12,13.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

Soft foams alone are generally not suited for use as a material for the ironing board of the present invention, The deformation/tensile strength of soft foams (for example, foams having some kinds of PUR or soft-PVC) is low, but the elastic strain is high. The present invention preferably uses a medium or high density polypropylene foam which provides the desired strength, stiffness and hardness of the top of the ironing board for use in the present invention.

We claim:

1. An ironing board comprising:

an ironing board top which comprises a one-piece molded body comprising a hard foam plastics material; and a stand having first and second legs and guide and bearing means for movably connecting said first and second legs to said molded body;

wherein said guide and bearing means comprise a guide and bearing rail on each longitudinal side of said molded body and a connecting part connecting said guide and bearing rails to thereby form a U-shaped frame part;

wherein said guide and bearing rails are arranged to guide movement of said first leg, and said connecting part is connected to said second leg; and wherein said stand includes at least one spring interposed between said guide and bearing means and one of said legs.

2. The ironing board of claim 1, wherein said first leg includes a pair of tubes.

3. The ironing board of claim 1, further comprising a pivot pin connected to said connecting part and said second leg and enabling pivotal movement of said second leg relative to said molded body.

4. The ironing board of claim 1, wherein said guide and bearing rails and said connecting part comprise metal.

5. The ironing board of claim 1, wherein said at least one spring comprises a torsion spring.

6. The ironing board of claim 1, wherein said molded body has integral detent means for receiving a portion of a leg of an ironing stand.

7. The ironing board of claim 6, wherein said detent means are arranged proximate to a longitudinal end of said molded body.

8. The ironing board of claim 1, wherein said molded body has integral handles.

9. The ironing board of claim 8, wherein said handles are arranged in an approximately central location along longitudinal sides of said molded body.

10. The ironing board of claim 1, further comprising a thermal-radiation-reflecting coating or layer arranged on an upper surface of said molded body.

* * * * *